US006316990B1

(12) United States Patent
Tanizawa

(10) Patent No.: US 6,316,990 B1
(45) Date of Patent: Nov. 13, 2001

(54) CONSTANT CURRENT SUPPLY CIRCUIT

(75) Inventor: Yukihiko Tanizawa, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/699,556

(22) Filed: Oct. 31, 2000

(30) Foreign Application Priority Data

Nov. 1, 1999 (JP) ..... 11-310970

(51) Int. Cl.[7] ..... G05F 1/10

(52) U.S. Cl. ..... 327/538; 327/540; 327/513; 323/312; 323/315

(58) Field of Search ..... 327/512, 513, 327/378, 83, 538, 540, 541, 542, 543; 323/312, 313, 314, 315; 374/178, 183, 184, 185

(56) References Cited

U.S. PATENT DOCUMENTS 3,956,661 * 5/1976 Sakamoto et al. ..... 327/513
4,591,778 * 5/1986 Holland ..... 320/39
4,990,846 * 2/1991 Buck et al. ..... 323/314
5,780,921 * 7/1998 Mitsuishi ..... 257/578

FOREIGN PATENT DOCUMENTS 5-60623 3/1993 (JP) .

* cited by examiner

*Primary Examiner*—Tuan T. Lam
*Assistant Examiner*—An T. Luu
(74) *Attorney, Agent, or Firm*—Law Office of David. G. Posz

(57) ABSTRACT

A primary transistor has a collector connected to one end of an electric load for controlling current supplied to the electric load. A current path resistor, having no temperature characteristics, is connected between an emitter of the primary transistor and a ground terminal. First, second, third and fourth resistors are identical in type and serially connected in this order between a power source potential VCC and the ground terminal. A secondary transistor, being identical in type with the primary transistor, has a collector connected to a connecting point of the second resistor and the third resistor, a base connected to a connecting point of the third resistor and the fourth resistor, and an emitter connected to the ground terminal. The primary transistor has a base connected to a connecting of the first resistor and the second resistor. The resistance values of the first to fourth resistors are set in such a manner that a voltage value applied between both end of the current path resistor is constant irrespective of temperature.

6 Claims, 5 Drawing Sheets

CONSTANT CURRENT SUPPLY CIRCUIT

BACKGROUND OF THE INVENTION

The present invention relates to a constant current supply circuit for supplying constant current to an electric load via a bipolar transistor.

FIG. 5 shows a constant current supply circuit disclosed in the unexamined Japanese patent publication No. 5-60623. An electric load L has one end connected to a ground terminal and the other end connected to an emitter of a primary transistor Q100. The primary transistor Q100 is an NPN-type transistor which controls the current supplied to the electric load L. A first resistor 101, a second resistor 102, a third resistor 103, and a fourth resistor 104 are serially connected between a high-potential terminal VCC and a ground-potential terminal of a power source. A secondary transistor Q200, being an NPN-type transistor, has a collector connected to a connecting point of the second resistor 102 and the third resistor 103, a base connected to a connecting point of the third resistor 103 and the fourth resistor 104, and an emitter connected to the ground-potential terminal of the power source. A base of the primary transistor Q100 is connected to a connecting point of the first resistor 101 and the second resistor 102. A positive voltage terminal 105, having an electric potential VD higher than the ground potential, is connected to a collector of the primary transistor Q100.

According to this conventional constant current supply circuit, the electric load L receives a constant current (i.e., load current) I from the terminal 105 via the primary transistor Q100. The electric load L has temperature characteristics in its resistance value R. To compensate such temperature characteristics, the relationship among resistance values of the first to fourth resistors 101 to 104 (especially, a resistance ratio of the third resistor 103 to the fourth resistor 104) is determined in such a manner that a voltage E applied between both ends of the electric load L adequately varies in accordance with the temperature. With this setting, the load current I is maintained at a constant value irrespective of temperature change.

However, the above-described conventional constant current supply circuit has the following problems.

It is now assumed that TCRL represents a resistance temperature coefficient of the electric load L, Rtyp represents a typical resistance value of the load resistance R at a reference temperature Ttyp, and ΔT represents a temperature deviation from the reference temperature Ttyp.

Using the above, the load resistance R can be expressed by the formula Rtyp(1+TCRL×ΔT). The temperature characteristics of the load resistance R is Rtyp×TCRL×ΔT. In other words, the load resistance R causes a variation equivalent to Rtyp×TCRL×ΔT in response to the temperature deviation ΔT from the reference temperature Ttyp. Thus, the temperature characteristics of the electric load L varies in accordance with a change of the typical resistance value Rtyp of the load resistance R.

However, according to the above-described conventional constant current supply circuit, the resistance values of the resistors 101 to 104 are determined in such a manner that the voltage E applied between the both ends of the electric load L varies in accordance with the temperature so as to compensate the temperature characteristics of the load resistance R. Accordingly, the optimum resistance values of the resistors 101 to 104 vary in response to the deviation of the typical value Rtyp of the load resistance R.

Hence, the resistance values of the resistors 101 to 104 need to be adjusted for each electric load L. This forces the workers to perform very complicated adjustment which is not practically feasible.

The electric load L may be a pressure sensing element of a Wheatstone bridge circuit consisting of four strain gauges made of diffused resistors. The resistance value of each diffused resistor has a dispersion range of approximately ±10~20% due to manufacturing error of the diffusion density of impurities or the width of resistor wire. It is therefore difficult to adopt the above-described conventional constant current supply circuit to this kind of pressure sensor.

SUMMARY OF THE INVENTION

In view of the foregoing problems, the present invention has an object to provide a constant current supply circuit capable of supplying constant current to an electric load irrespective of temperature, even when the resistance value of the electric load is not constant due to the manufacturing error.

To accomplish the above and other related objects, the present invention provides a constant current supply circuit for supplying constant current to an electric load. The constant current supply circuit comprises a primary transistor having a collector connected to one end of the electric load for controlling current supplied to the electric load. A current path resistor is connected between an emitter of the primary transistor and a reference voltage terminal for forming an electric path supplying the current to the electric load via the primary transistor. First, second, third and fourth resistors are serially connected in this order between one potential terminal of an electric power source and the other potential terminal of the electric power source. A secondary transistor, being identical in type with the primary transistor, has a collector connected to a connecting point of the second resistor and the third resistor, a base connected to a connecting point of the third resistor and the fourth resistor, and an emitter connected to the other potential terminal of the electric power source. The primary transistor has a base connected to a connecting point of the first resistor and the second resistor.

According to this arrangement, load current I is supplied via the primary transistor to the electric load. The load current I is substantially identical with current I' flowing across the current path resistor. The type and the resistance value of respective first to fourth resistors can be optimized so that a voltage applied between both ends of the current path resistor is maintained at a constant value irrespective of temperature. Thus, it becomes possible to supply constant load current I to the electric load even when the resistance value of a manufactured electric load (i.e., actual load resistance) is different from a designated value.

Preferably, the first and second resistors are identical in type with the third and fourth resistors, and resistance values of the first, second, third and fourth resistors satisfy the following relationship:

$$0.5 < \gamma = \frac{R1}{R1 + R2} \cdot \frac{R3 + R4}{R4} < 1.5$$

where R1 represents a resistance value of the first resistor, R2 represents a resistance value of the second resistor, R3 represents a resistance value of the third resistor, and R4 represents a resistance value of the fourth resistor.

For example, to obtain preferable characteristics, the resistance values R1 to R4 of the first to fourth resistors are set to satisfy γ=1.

Preferably, the current path resistor is a thin-film resistor.

Preferably, a direct-current amplification factor of the primary transistor to the secondary transistor is equal to or larger than 50.

Preferably, each of the primary transistor and the secondary transistor is constituted by a pair of transistor elements connected in a Darlington pattern.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Figure 1:
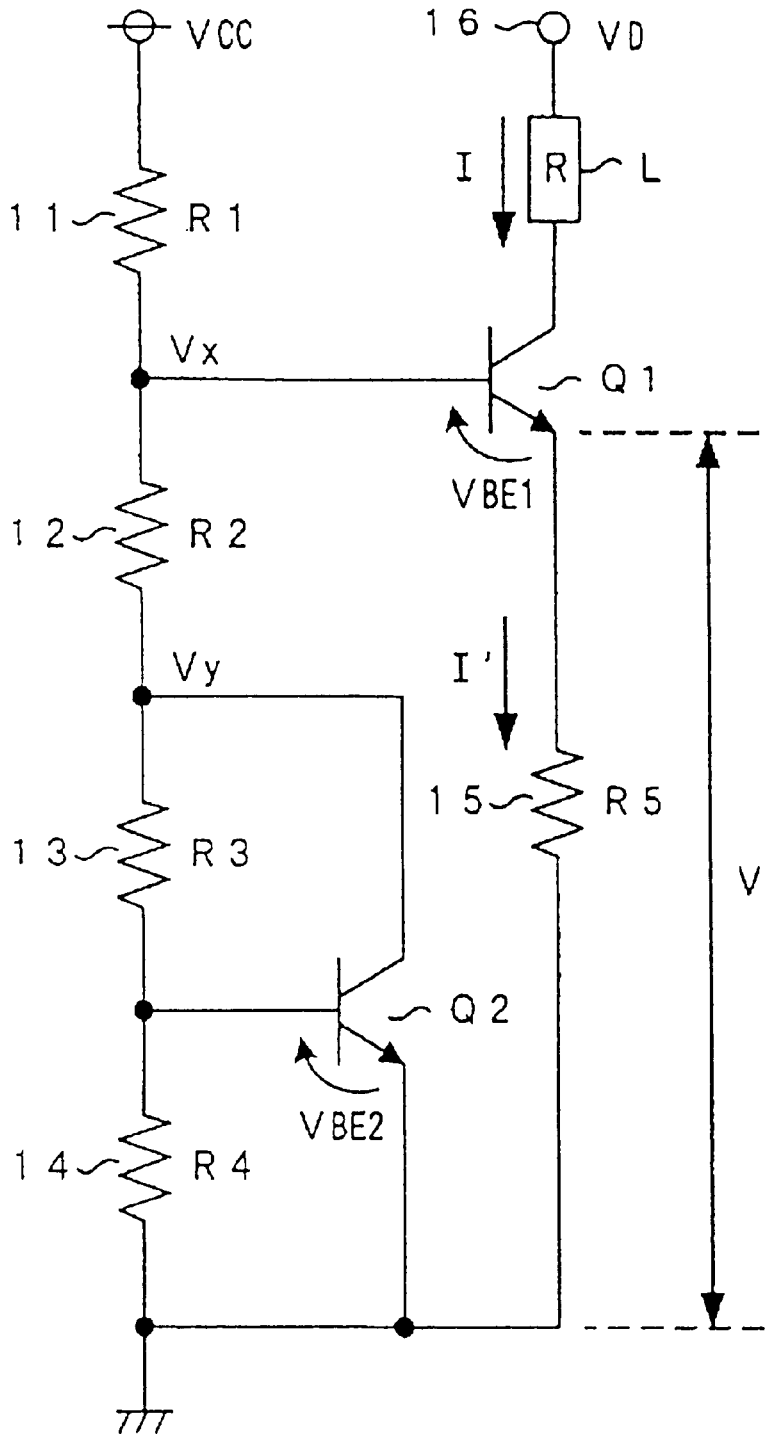
FIG. 1 is a circuit diagram showing a constant current supply circuit in accordance with a first embodiment of the present invention.

FIG. 1 is a circuit diagram showing a constant current supply circuit in accordance with a first embodiment of the present invention.

A current path resistor 15 has one end connected to a reference voltage terminal which is a ground terminal (=0V). An electric power source has a high-potential terminal (=VCC) and a low-potential terminal (=0V). Thus, the high-potential terminal of the electric power source supplies a positive voltage VCC. One end of first resistor 11 is connected to the high-potential terminal (=VCC) of the electric power source. One end of fourth resistor 14 and an emitter of secondary transistor Q2 are connected to the low-potential terminal (i.e., ground terminal) of the electric power source.

A primary transistor Q1, which is an NPN type transistor, has a collector connected to an electric load L. The primary transistor Q1 controls current supply to the electric load L. The other end of the electric load L is connected to a current supply terminal 16 which has a positive potential VD higher than the ground potential.

The current path resistor 15, connected between an emitter of the primary transistor Q1 and the ground terminal of the electric power source, has a resistance temperature coefficient substantially equal to 0. In other words, the current path resistor 15 has no temperature characteristics. The current path resistor 15 forms a current path for supplying current to the electric load L via the primary transistor Q1.

The current path resistor 15 is a thin-film resistor which is formed on a semiconductor integrated circuit. This kind of thin-film resistor is free from temperature characteristics. The resistance temperature coefficient of the thin-film resistor is substantially equal to 0.

The first resistor 11, second resistor 12, third resistor 13, and fourth resistor 14 are sequentially connected in this order between the high-potential terminal and the low-potential terminal of the electric power source.

The secondary transistor Q2, being an NPN transistor identical in type with the primary transistor Q1, has a collector connected to a connecting point of the second resistor 12 and the third resistor 13. A base of the secondary transistor Q2 is connected to a connecting point of the third resistor 13 and the fourth resistor 14. An emitter of the secondary transistor Q2 is connected to the ground terminal.

R1, R2, R3, R4 and R5 represent resistance values of the first to fourth resistors 11, 12, 13 and 14, and the current path resistor 15. VBE1 represents a base-emitter voltage of the primary transistor Q1. VBE2 represents a base-emitter voltage of the secondary transistor Q2. A direct-current amplification factor (hfe) of the primary transistor Q1 to the secondary transistor Q2 is sufficiently large. Each base current of the transistors Q1 and Q2 is negligible.

The following formula 1 shows a relationship between an electric potential Vx of the connecting point of the first resistor 11 and the second resistor 12 and an electric potential Vy of the connecting point of the second resistor 12 and the third resistor 13.

$$\begin{aligned} Vx &= Vy + \frac{R2}{R1+R2}(VCC - Vy) \\ &= \frac{R3+R4}{R4}VBE2 + \frac{R2}{R1+R2}\left(VCC - \frac{R3+R4}{R4}VBE2\right) \\ &= \frac{R2}{R1+R2}VCC + \frac{R1}{R1+R2}\cdot\frac{R3+R4}{R4}VBE2 \end{aligned} \tag{1}$$

When the direct-current amplification factor (hfe) of the primary transistor Q1 to the secondary transistor Q2 is sufficiently large, the load current I flowing across the electric load L can be regarded as substantially equal to the current I' flowing across the current path resistor 15. The electric potential Vx of the connecting point of the first resistor 11 and the second resistor 12 is expressed by the following equation 2.

$$Vx = R5\cdot I' + VBE1 = R5\cdot I + VBE1 \tag{2}$$

From the above equations (1) and (2), the load current I flowing across the electric load L is expressed by the following formula 3.

$$\left.\begin{aligned} I &= \frac{1}{R5}\left(\frac{R2}{R1+R2}VCC + \gamma\cdot VBE2 - VBE1\right) \\ \gamma &= \frac{R1}{R1+R2}\cdot\frac{R3+R4}{R4} \end{aligned}\right\} \tag{3}$$

In the above formula 3, the value in parentheses represents a voltage V applied between both ends of the current path resistor 15.

The primary transistor Q1 is identical in type (i.e., NPN-type transistor) with the secondary transistor Q2. Thus, the base-emitter voltage VBE1 of the primary transistor Q1 is substantially equal to the base-emitter voltage VBE2 of the secondary transistor Q2 irrespective of temperature. The first resistor 11 and the second resistor 12 are identical in type with the third resistor 13 and the fourth resistor 14. And,, the resistance values of first, second, third and fourth resistors 11~14 satisfy the following relationship:

$$\gamma = \frac{R1}{R1+R2} \cdot \frac{R3+R4}{R4} = 1$$

In other words., the resistance values of first, second, third and fourth resistors 11~14 are set so as to cancel the VBE1 and VBE2 each varying largely in accordance with a temperature change.

The voltage V applied between both ends of the current path resistor 15 becomes V=VCC×R2/(R1+R2). The load current I is expressed by the following formula 4.

$$I = \frac{1}{R5} \cdot \frac{R2}{R1+R2} VCC \tag{4}$$

When the first resistor 11 and the second resistor 12 are identical in type with the third resistor 13 and the fourth resistor 14, the mutual resistance temperature coefficient of the first resistor 11 and the second resistor 12 is identical with the mutual resistance temperature coefficient of the third resistor 13 and the fourth resistor 14. Thus, the above equation γ=1 is established irrespective of temperature. The voltage V (=VCC×R2/(R1+R2)) applied between the both ends of the current path resistor 15 is maintained at a constant value irrespective of the temperature and the resistance value R of the electric load L.

The resistance temperature coefficient of the current path resistor 15 is substantially 0. As can be understood from the above-equation (4), the load current I flowing across the electric load L is maintained at a constant value irrespective of the temperature and the load resistance R.

In this manner, according to the constant current supply circuit of the present invention, the load current I supplied to the electric load L can be maintained at a constant value irrespective of temperature change even if the resistance value R of the electric load L varies. Thus, no adjustment of resistors is necessary for each electric load L.

In the above-described constant current supply circuit, it is preferable that the direct-current amplification factor of the primary transistor Q1 to the secondary transistor Q2 is large because the base current reduces to a negligible level. The collector current becomes substantially identical with the emitter current. The above formulas (1) to (4) are surely established. Practically, it is referable that the direct-current amplification factor of the primary transistor Q1 to the secondary transistor Q2 is equal to or larger than 50. It will be more preferable that the direct-current amplification factor is equal to or larger than 100. More specifically, when the direct-current amplification factor is in a level equivalent to 50, the error of the load current I due to influence of the base current becomes approximately 2%. This gives no bad influence to the accuracy. When the direct-current amplification factor is larger than 50, more preferable performance will be obtained.

From the foregoing, each of the primary transistor and the secondary transistor is constituted by a pair of transistor elements connected in a Darlington pattern, so that the direct-current amplification factor of the primary transistor Q1 to the secondary transistor Q2 becomes an extremely large value. Regarding the resistance values R1~R4 of the first to fourth resistors 11 to 14, it is preferable that the following relationship is established.

$$0.5 < \gamma = \frac{R1}{R1+R2} \cdot \frac{R3+R4}{R4} < 1.5 \tag{5}$$

The reason for setting the above relationship 5 is as follows.

First, resistors for the integrated circuits are usually subjected to large manufacturing errors. The dispersion range of resistance value is approximately ±20% in case of diffused resistors or thin-film resistors. The dispersion range of the ratio of resistance values in a same chip is generally ±1~2% depending on line width. Accordingly, the value of γ in the equations (3) and (5) is believed to be 1±several %.

An allowable error amount of γ can be estimated based on the calculation of the value in the parentheses of the above formula (3).

For example, the result will slightly vary depending on the setting of the temperature range (temperature variation) ΔT, the allowable variation of the load current I, and setting of VCC×R2/(R1+R2). It is now assumed that ΔT is 50° C., the allowable variation of the load current I is ±5%, and VCC×R2/(R1+R2) is 1.0V. In this condition, the temperature variation of the base-emitter voltage VBE of the bipolar transistor is approximately −2 mV/° C. From the formula (3), $\pm 5\% = (\gamma - 1) \times |-2 \times 10^{-3}| \times 50/1.0 \times 100\%$ Thus, $0.5 < \gamma < 1.5$ When the value of γ is within ±50% with respect to an ideal value 1, the value in the parentheses of the formula (3) varies within a range of ±5% in response to the temperature.

The constant current supply circuit of the present invention is constituted by a semiconductor integrated circuit. In this case, the characteristics of the primary transistor Q1 and the secondary transistor Q2 can be equalized by configuring them in the same shape and disposing them in the same direction.

When the primary transistor Q1 and the secondary transistor Q2 have the same characteristics, the base-emitter voltage VBE1 of the primary transistor Q1 is surely equalized with the base-emitter voltage VIBE2 of the secondary transistor Q2. Thus, the above formulas (1) to (5) can be established.

In the setting of resistance values R1~R5 of the resistors 11~15, it is desirable that the current flowing across the primary transistor Q1 becomes equal to the current flowing across the secondary transistor Q2 at the reference temperature Rtyp. In other words, it is easy to equalize the base-emitter voltage VBE1 of the primary transistor Q1 with the base-emitter voltage VBE2 of the secondary transistor Q2.

Only the ratio of the resistance values R1~R4 of the first to fourth resistors 11~14 gives influence to the constant current supply circuit of the present invention. The resistance temperature coefficient of each resistor needs not be 0. The first to fourth resistors 11~14 can be made of diffused resistors or base resistors which have large temperature characteristics. It is preferable that the first resistor 11 and the second resistor 12 have the same resistance temperature coefficient while the third resistor 13 and the fourth resistor 14 have the same resistance temperature coefficient. The first to fourth resistors 11~14 are identical in type. The first to fourth resistors 11~14 can be made of thin-film resistors having no temperature characteristics.

According to the constant current supply circuit of the present invention, as understood from the formula (4), the load current I varies in proportion to the power source voltage VCC. Thus, the constant current supply circuit of the present invention has power source ratio characteristics.

In FIG. 1, the electric load L is a pressure sensing element of a Wheatstone bridge circuit consisting of four strain gauges made of diffused resistors.

The constant current supply circuit shown in FIG. 1 is constituted by a semiconductor integrated circuit. The current path resistor 15 is a thin-film resistor made of Cr·Si having no temperature characteristics or other comparable metal. The first to fourth resistors 11~14 are diffused resistors having substantially the same temperature characteristics.

The primary transistor Q1 and the secondary transistor Q2 are identical in type with each other and are disposed in the same direction, so that the transistors Q1 and Q2 have the same characteristics. The direct-current amplification factor of the primary transistor Q1 to the secondary transistor Q2 is equal to or larger than 100, so that the base current is negligible.

The first to fourth resistors 11~14 have resistance values R1~R4 satisfying the relationship $\gamma=1$ at the reference temperature Ttyp.

According to the constant-current supply circuit in accordance with the first embodiment, the load current I supplied to the pressure sensing element can be maintained at a constant value irrespective of temperature even if the resistance value of respective gauge resistors constituting the pressure sensing element varies.

To supply a constant current to the pressure sensing element, it is desirable that the voltage VR applied to the pressure sensing element is large enough. The pressure sensing element can produce a large output voltage sufficient to accurately detect the pressure.

According to the constant current supply circuit of the first embodiment, the voltage VR applied to the pressure sensing element (i.e., electric load L) is defined by the following formula 6.

$$VR = VD - VCEQ1 - V \tag{6}$$

$$= VD - VCEQ1 - VCC \times R2/(R1 + R2)$$

The following formula 7 defines a maximum value VRMAX of the above voltage VR.

$$VRMAX = VD - VCEQ1(sat) - VCC \times R2/(R1 + R2) \tag{7}$$

$$= VD - VCEQ1(sat) - VCC \times R3/(R3 + R4)$$

where VCEQ1(sat) represents a collector-emitter voltage of the primary transistor Q1 in a saturated state.

From the foregoing, it is possible to adjust the maximum value VRMAX by adequately setting the resistance ratio of the first resistor 11 to the second resistor 12 and the resistance ratio of the third resistor 13 to the fourth resistor 14. It is however necessary to consider the operating temperature range in determining the above each resistance ratio because VCEQ1(sat) and VRMAX vary in accordance with the temperature.

VR=load current I×load resistance R. The load current I is proportional to a reciprocal of the resistance value R5 of the current path resistor 15. It is therefore possible to change the value of VR by adjusting the resistance value R5 of the current path resistor 15. In this case, laser trimming the current path resistor 15 is preferable when the resistor 15 is made of a thin-film resistor.

Figure 2:
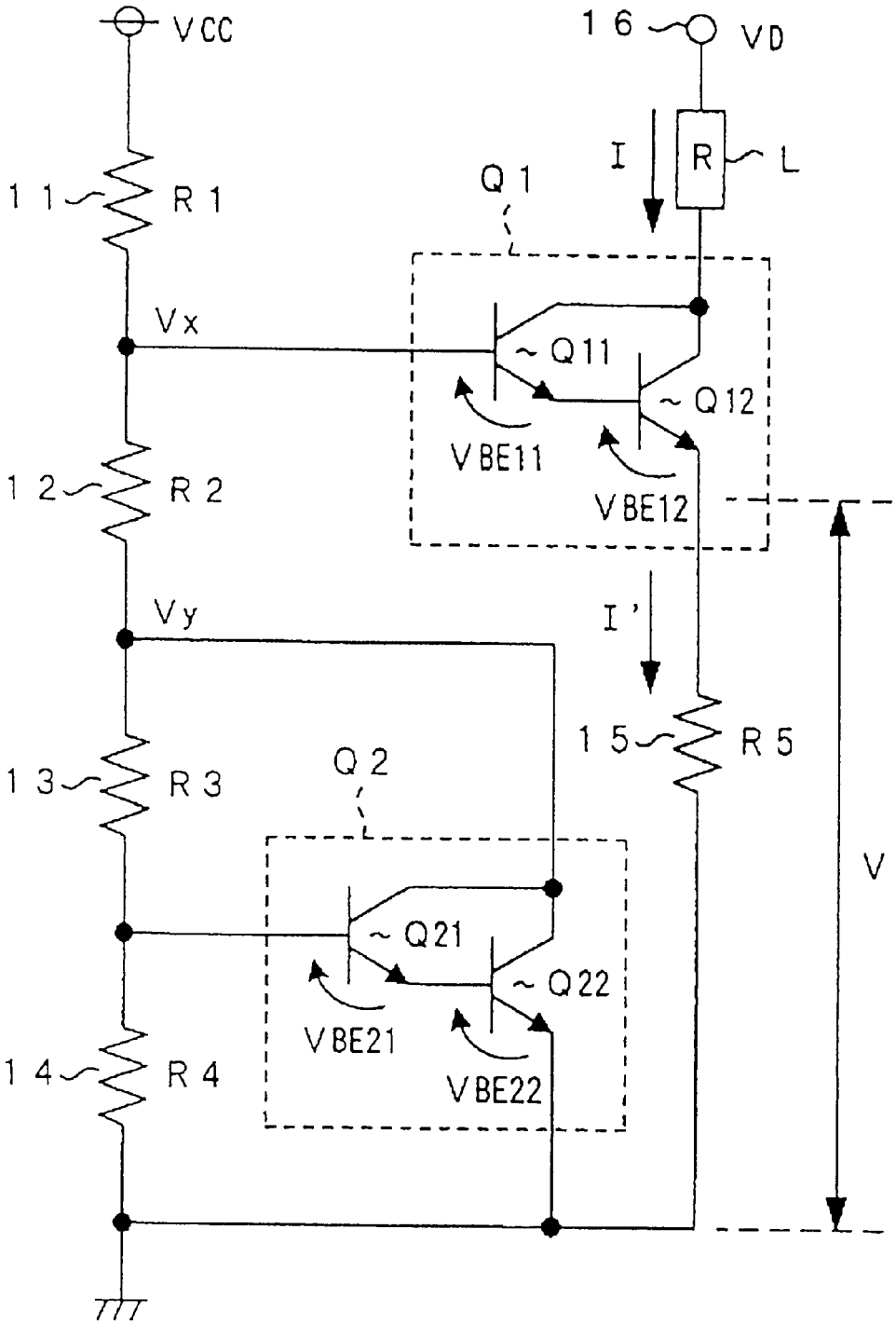
FIG. 2 is a circuit diagram showing a constant current supply circuit in accordance with a second embodiment of the present invention.

FIG. 2 shows a constant current supply circuit in accordance with a second embodiment. The constant current supply circuit of the second embodiment differs from the constant current supply circuit of the first embodiment in that the primary transistor Q1 consists of a pair of transistor elements Q11 and Q12 which are connected in a Darlington pattern. Similarly, the secondary transistor Q2 consists of a pair of transistor elements Q21 and Q22 which are connected in a Darlington pattern.

According to the circuit arrangement of the second embodiment, the direct-current amplification factor of the primary transistor Q1 to the secondary transistor Q2 is extremely large. The substantial base current of respective transistors Q1 and Q2 can be reduced greatly. The above formulas 1 to 5 can be surely established. The accuracy of the constant current increases.

It is now assumed that, in the primary transistor Q1 of Darlington type, VBE11 represents a base-emitter voltage of the first-stage transistor Q11 and VBE12 represents a base-emitter voltage of the second-stage transistor Q12. In the secondary transistor Q2 of Darlington type, VBE21 represents a base-emitter voltage of the first-stage transistor Q21 and VBE22 represents a base-emitter voltage of the second-stage transistor Q22.

$$VBE1 = VBE11 + VBE12$$

$$VBE2 = VBE21 + VBE22$$

Figure 3:
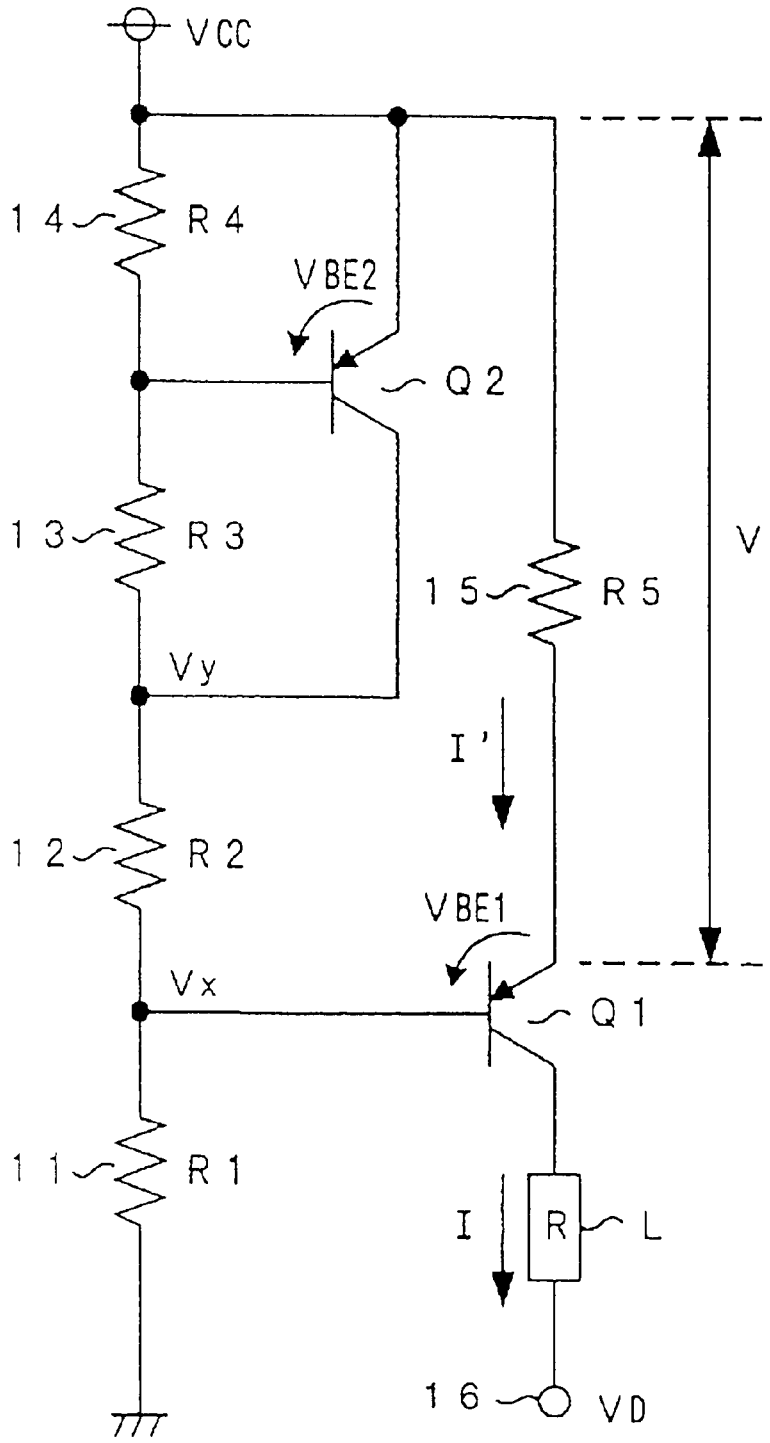
FIG. 3 is a circuit diagram showing a constant current supply circuit in accordance with a third embodiment of the present invention.

FIG. 3 shows a constant current supply circuit in accordance with a third embodiment. The constant current supply circuit of the third embodiment differs from the constant current supply circuit of the first embodiment in the following points (I) to (III).

(I) A low-potential terminal (having a ground potential) of the electric power source is connected to one end of the first resistor 11. A high-potential terminal (having a power source voltage VCC) of the electric power source is connected to one end of the fourth resistor 14 and the emitter of the secondary transistor Q2. Namely, the constant current supply circuit of the third embodiment differs from the constant current supply circuit of the first embodiment in that the first to fourth resistors 11 to 14 are serially connected in the opposite order between the high-potential and low-potential terminals of the electric power source.

(II) Furthermore, one end of the current path resistor 15 is connected to the high-potential terminal of the electric power source. In other words, the reference potential of the current path resistor 15 is VCC. The other end of the current path resistor 15 is connected to the emitter of the primary transistor Q1. The base of the primary transistor Q1 is connected to the connecting point of the first resistor R1 and the second resistor R2. The collector of the primary transistor Q1 is connected to one end of the electric load L. The other end of the electric load L is connected to the current supply terminal 16 having an electric potential VD which is lower than the power source potential VCC.

(III) The primary transistor Q1 and the secondary transistor Q2 are PNP transistors.

The constant current supply circuit of the third embodiment brings substantially the same function and effect as those of the constant current supply circuit of the first embodiment.

Figure 4:
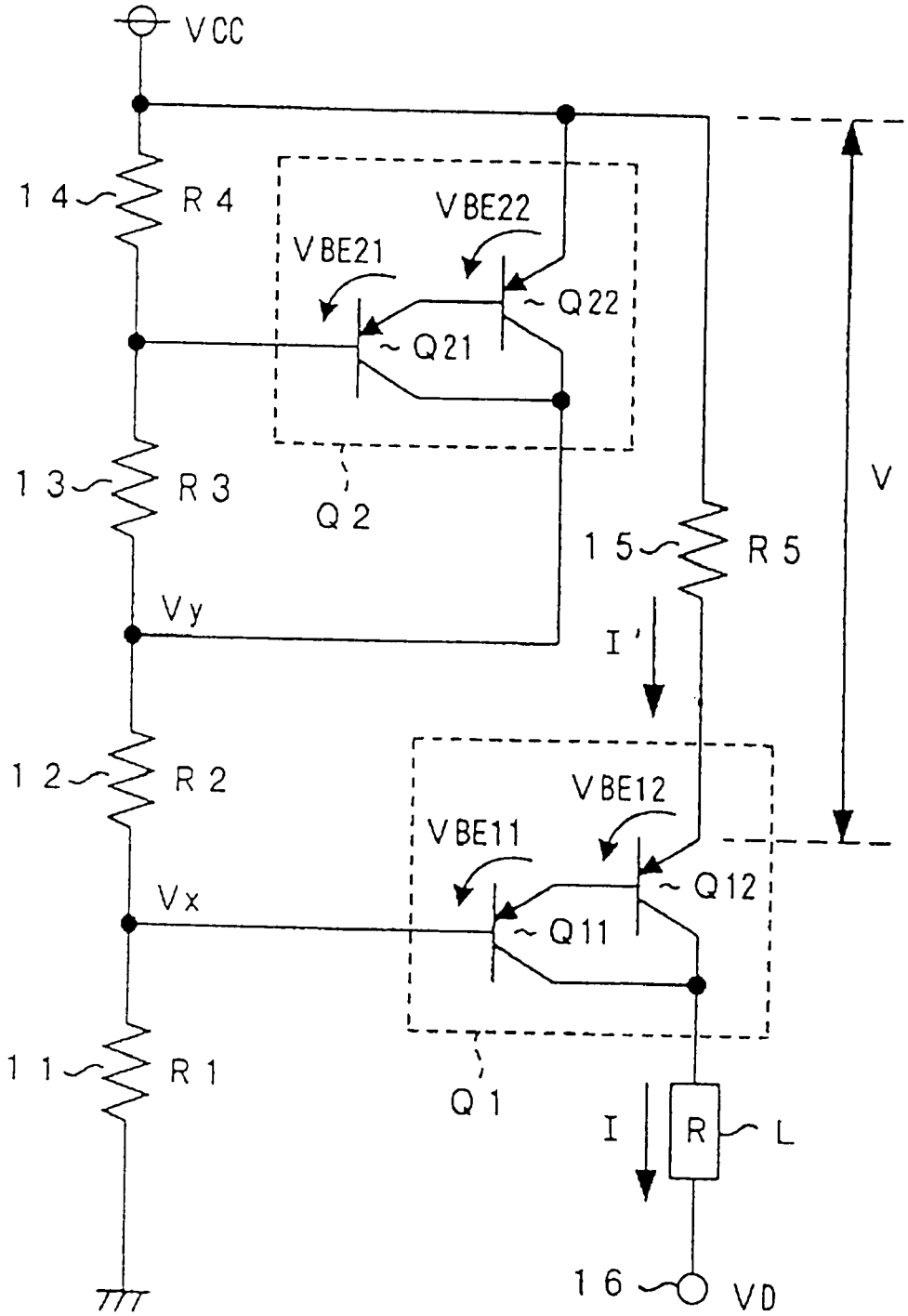
FIG. 4 is a circuit diagram showing a constant current supply circuit in accordance with a fourth embodiment of the present invention.
Figure 5:
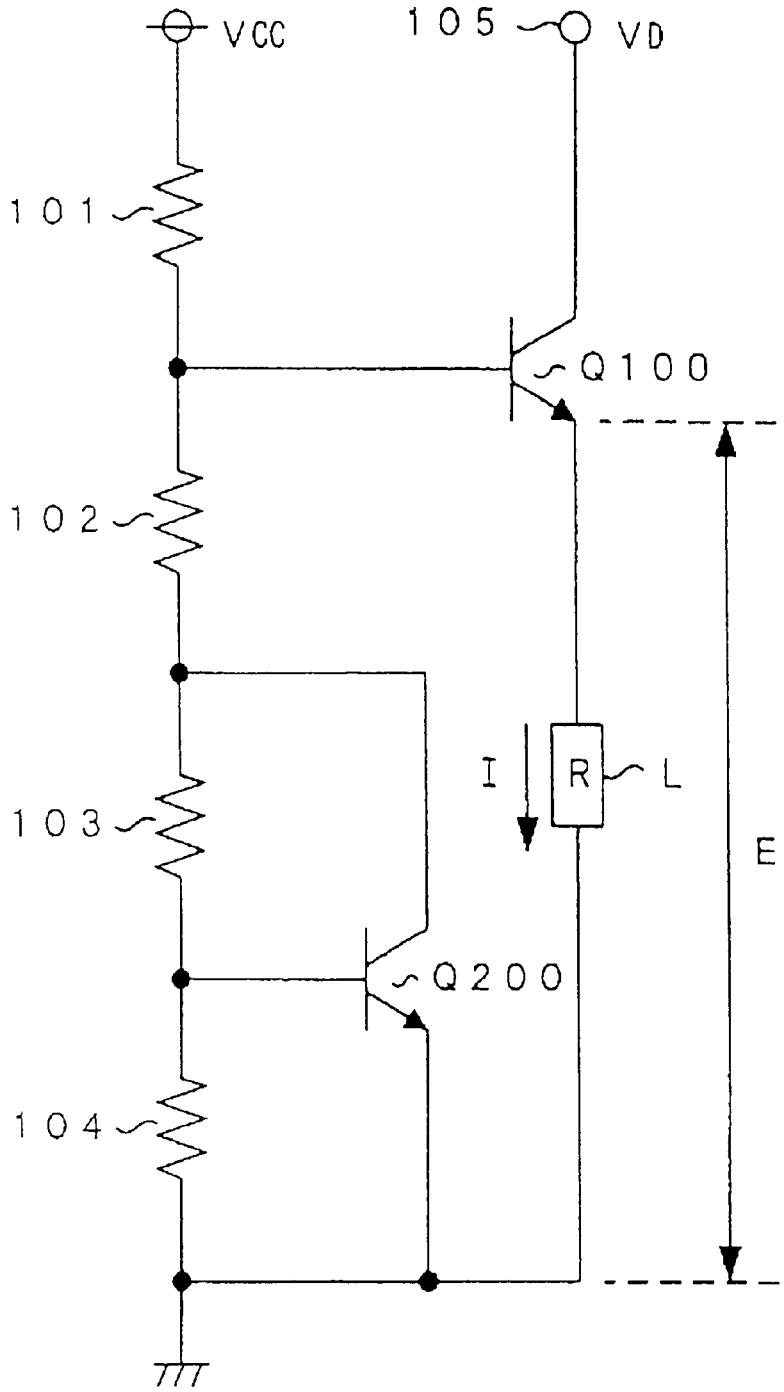
FIG. 5 PRIOR ART
FIG. 5 is a circuit diagram showing a conventional constant current supply.

FIG. 4 shows a constant current supply circuit in accordance with a fourth embodiment. The constant current supply circuit of the fourth embodiment differs from the constant current supply circuit of the third embodiment in that the primary transistor Q1 of PNP type consists of a pair of transistor elements Q11 and Q12 which are connected in a Darlington pattern. Similarly, the secondary transistor Q2 of PNP type consists of a pair of transistor elements Q21 and Q22 which are connected in a Darlington pattern.

The constant current supply circuit of the fourth embodiment brings substantially the same function and effect as those of the constant current supply circuit of the third embodiment. Namely, the direct-current amplification factor of the primary transistor Q1 to the secondary transistor Q2 is extremely large. The substantial base current of respective transistors Q1 and Q2 can be reduced greatly. As a result, the accuracy of the constant current increases The PNP transistor tends to have a small direct-current amplification factor compared with the NPN transistor. Thus, it is preferable to employ Darlington transistors as shown in FIG. 4.

The present invention is not limited to the above-described embodiments, and therefore can be variously modified.

For example, it is preferable to provide a predetermined potential difference, which is not temperature dependent, between the emitter of the secondary transistor Q2 and the other end of the current path resistor 15.

The electric load is not limited to the pressure sensing element. And, therefore, the constant current supply circuit of the present invention can be applied to various resistive loads.

The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A constant current supply circuit for supplying constant current to an electric load, said constant current supply circuit comprising:

a primary transistor having a collector connected to one end of said electric load for controlling current supplied to said electric load;

a current path resistor, having a resistance temperature coefficient substantially equal to 0, connected between an emitter of said primary transistor and a reference voltage terminal for forming an electric path supplying the current to said electric load via said primary transistor;

first, second, third and fourth resistors serially connected in this order between one potential terminal of an electric power source and the other potential terminal of said electric power source;

a secondary transistor, being identical in type with said primary transistor, having a collector connected to a connecting point of said second resistor and said third resistor, a base connected to a connecting point of said third resistor and said fourth resistor, and an emitter connected to said other potential terminal of said electric power source; and said primary transistor having a base connected to a connecting point of said first resistor and said second resistor.

2. The constant current supply circuit in accordance with claim 1, wherein said first and second resistors are identical in type with said third and fourth resistors, and resistance values of said first, second, third and fourth resistors satisfy the following relationship:

$$0.5 < \gamma = \frac{R1}{R1 + R2} \cdot \frac{R3 + R4}{R4} < 1.5$$

where R1 represents a resistance value of the first resistor, R2 represents a resistance value of the second resistor, R3 represents a resistance value of the third resistor, and R4 represents a resistance value of the fourth resistor.

3. The constant current supply circuit in accordance with claim 2, wherein the resistance values R1 to R4 of said first to fourth resistors satisfy $\gamma=1$.

4. The constant current supply circuit in accordance with claim 1, wherein said current path resistor is a thin-film resistor.

5. The constant current supply circuit in accordance with claim 1, wherein a direct-current amplification factor of said primary transistor to said secondary transistor is equal to or larger than 50.

6. The constant current supply circuit in accordance with claim 1, wherein each of said primary transistor and said secondary transistor is constituted by a pair of transistor elements connected in a Darlington pattern.

* * * * *